US005306193A

United States Patent [19]

Yang

[11] Patent Number: 5,306,193

[45] Date of Patent: Apr. 26, 1994

[54] TOY DOUBLE CLUB WITH WHISTLES

[76] Inventor: Chia-Fa Yang, 100-4, Chung-Cheng Rd., Jeng-Te Shiang, Tainan Shien, Taiwan

[21] Appl. No.: 38,870

[22] Filed: Mar. 29, 1993

[51] Int. Cl.[5] ..... A63H 5/00; A63H 33/30

[52] U.S. Cl. ..... 446/215; 446/473; 482/12; 482/83; 273/84 R

[58] Field of Search ..... 446/213, 214, 215, 216, 446/207, 188, 192, 196, 473, 490, 486; 482/12, 83; 273/84 R

[56] References Cited

U.S. PATENT DOCUMENTS

| | | | |
|---|---|---|---|
| 1,883,724 | 10/1932 | Grubman | 446/196 |
| 2,302,318 | 11/1942 | Henry | 446/196 |
| 2,314,153 | 3/1943 | Marcus | 446/196 |
| 2,777,607 | 1/1957 | Bellandi | 446/197 |
| 3,454,274 | 7/1969 | Kaneshiro | 482/83 X |
| 3,937,468 | 2/1976 | Conde, Sr. | 482/83 X |
| 5,087,220 | 2/1992 | Cotita | 446/473 X |
| 5,120,261 | 6/1992 | Dietzman | 446/473 |

*Primary Examiner*—Danton D. DeMille
*Assistant Examiner*—D. Neal Muir

[57] ABSTRACT

A toy double club with whistle including two elongate tubular bodies connected with a chain, each tubular body having a whistle in its inner cavity to move back and forth in a limited distance, the distance being by two opposing projections on the inner surface of the tubular body. A coil spring is placed between the whistle and an outer end of each of the tubular bodies so that the whistle gives out whistling sounds when moved back and forth by the swinging movement of the tubular bodies.

2 Claims, 3 Drawing Sheets

TOY DOUBLE CLUB WITH WHISTLES

BACKGROUND OF THE INVENTION

A conventional toy nunchuck is made of two plastic tubes connected with a chain and gives out a quiet hissing sound only when it is swung with a great force, as when a child is imitating action or Kung fu movies. But it is quite dangerous to swing even a toy nunchuck with great force.

SUMMARY OF THE INVENTION

This invention has been devised to offer a toy nunchuck with whistles. The toy gives out whistling sound when either of two tubular bodies is swung around in the air, even when swung with little force.

The toy nunchuck with whistles is made of two elongated tubular bodies connected with a chain. Each tubular body has a movable whistle in its inner cavity abutting a coil spring in an outer end portion. The outer end of each tubular body is closed with a stopper with a central hole through which air passes, so that the whistle makes whistling sounds when the whistle is moved outward by centrifugal force and when moved inward by the elastic recoil of the coil spring during the swinging process of the two tubular bodies.

DETAILED DESCRIPTION OF THE INVENTION

Figure 1:
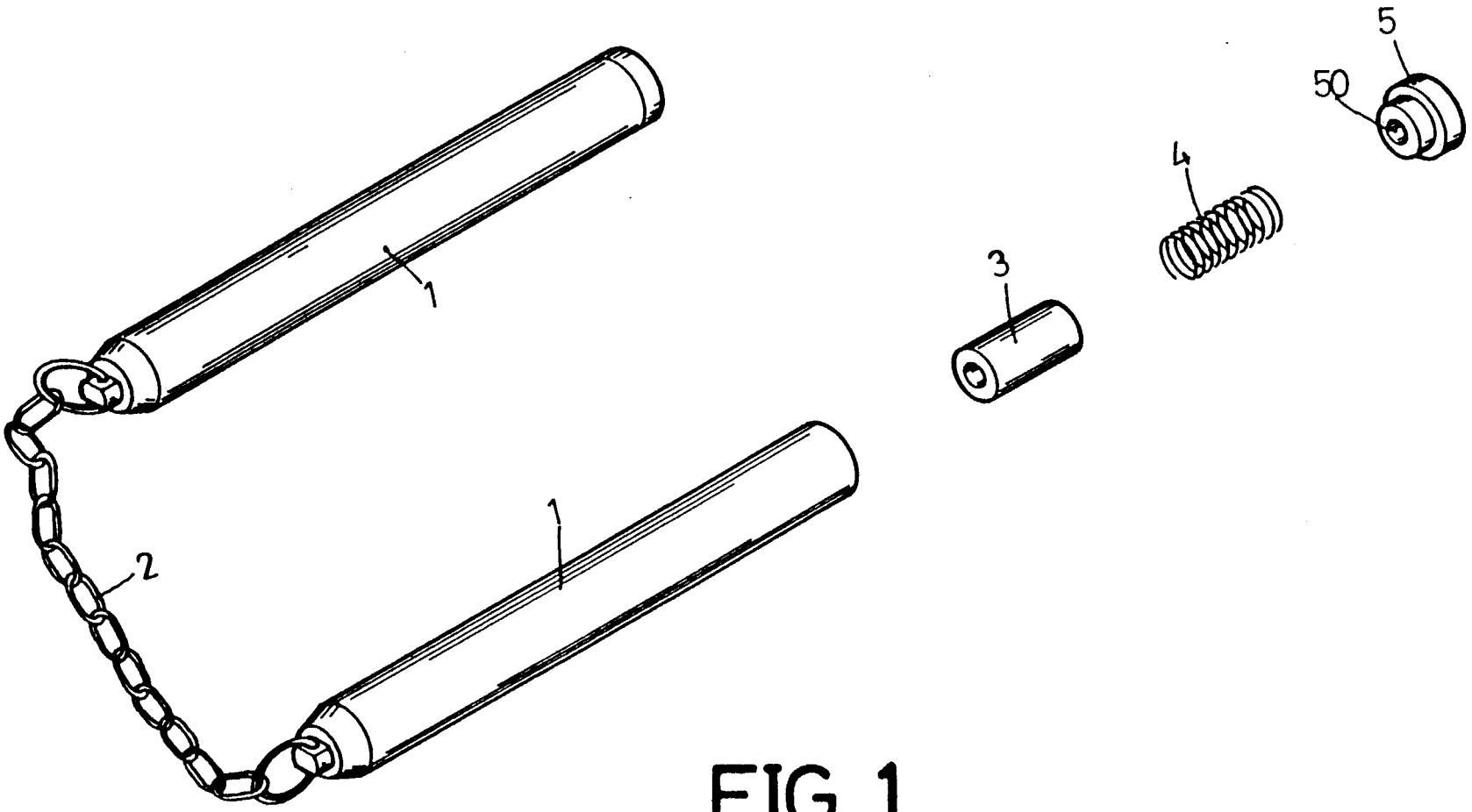
FIG. 1 is an exploded perspective view of a toy nunchuck of the present invention.
Figure 2:
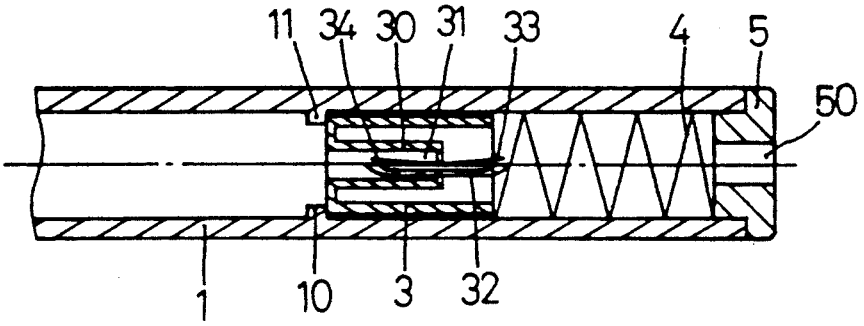
FIG. 2 is a partial cross-sectional view of the toy nunchuck with whistles of the present invention with the spring expanded.
Figure 3:
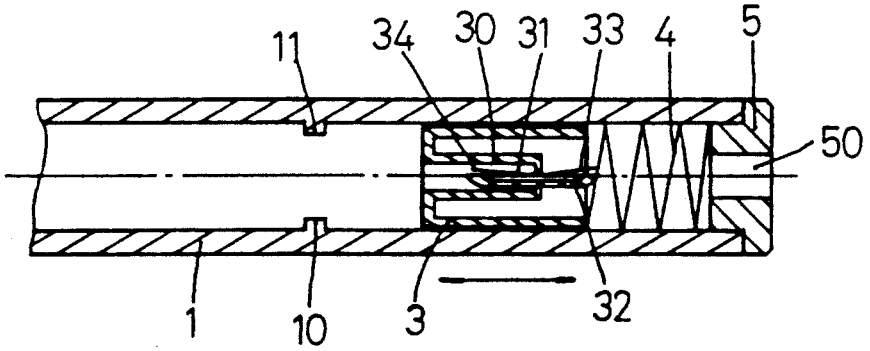
FIG. 3 is a cross-sectional view of the toy nunchuck with whistles of the present invention with the spring compressed.
Figure 4:
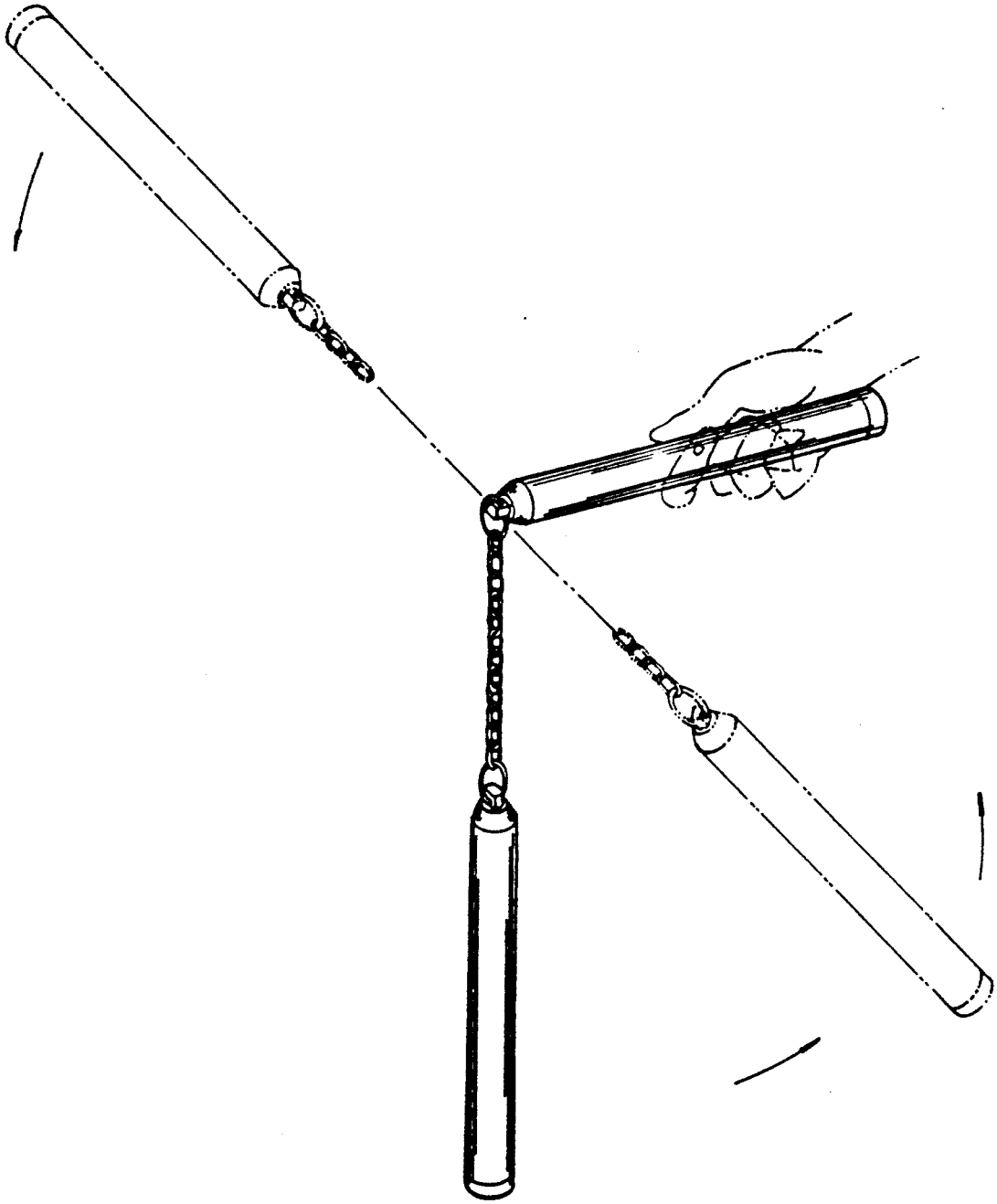
FIG. 4 is a perspective view of the toy nunchuck with whistles in use.

A toy nunchuck with whistles in the present invention, as shown in FIGS. 1–4, comprises two elongated tubular bodies, each having the same diameter and length. A chain 2 connects the two tubular bodies 1. Each tubular body 1 has two opposing projections 10, 11 and a stopper 5 closing an outer open end of the body 1. A coil spring 4 provides an opposing force to the centrifugal force.

The whistle 3 is cylindrical in shape. It has a round post 30, a hole 31 in the post 30, and semi-round tube 32 placed in the hole 31, and two thin membranes 33, 34 (shown in FIGS. 2 and 3) at the front and at the rear of the semi-round tube 32. The stopper 5 has a flange to fit around the open end of the tubular body 1 and a central through hole 50 for air to flow through.

When a user swings one of the two tubular bodies 1, centrifugal force causes the whistle 3 therein to move outward to compress the spring 4. The whistle moves back inward from the force of the spring and is stopped by the projections 10, 11 when the centrifugal force decreases. Thus, the whistle 3 moves back and forth inside the tubular body 1 by means of centrifugal force and elasticity of the coil spring 4. The thin membranes 33, 34 at the front and at the rear of the semi-round tube 32 give out sounds, fluttering up and down due to the air flowing through the whistle 3. In addition, the membranes 33, 34 are located separately inside and outside the round post 30 with different diametrical positions so that the two films give out different sounds.

What is claimed is:

1. A toy nunchuck with whistles comprising:

two elongated tubular bodies of the same diameter and length with a chain connecting said two tubular bodies, wherein each said tubular body having first and second ends, said body has a whistle contained in an inner cavity, said cavity being defined at a said first end by a stopper with a central hole capping said first end of the tubular bodies, the cavity being defined at a second end by opposing projections on the interior of the tubular bodies, the cavity including a coil spring that urges the whistle toward said second end of the bodies, so that the whistle moves between the two projections and the stopper, the whistle moving toward the stopper by centrifugal force generated by swinging the tubular bodies, and the whistle moving toward the projections when the centrifugal force is decreased so that the urging force of the coil spring overcomes said centrifugal force, so that with the intermittent application of centrifugal force caused by a user swinging the toy nunchuck with a high velocity, the whistle slides back and forth in the cavity, creating a whistling sound due to air flowing through the whistles.

2. The toy nunchuck with whistles as claimed in claim 1; wherein:

said whistles are cylindrical in shape, having a round post with a hole, a semi-round tube placed in said hole of the round post, and two thin films respectively placed at a front end and at a rear end of the semi-round tube, said two thin films fluttering to create a whistling sound when air flows through the semi-round tube.

* * * * *